US005499504A

United States Patent [19]

Mill et al.

[11] Patent Number: 5,499,504

[45] Date of Patent: Mar. 19, 1996

[54] DESK MOUNTED PERSONAL ENVIRONMENT SYSTEM

[75] Inventors: Peter D. Mill, Ottawa; Richard Tice, Halifax, both of Canada

[73] Assignee: Scots Pine Enterprises Ltd., c/o Perly-Robertson Panet, Hill & McDougall, Ottawa, Canada

[21] Appl. No.: 119,123

[22] PCT Filed: Mar. 19, 1992

[86] PCT No.: PCT/CA92/00121

§ 371 Date: Sep. 20, 1993

§ 102(e) Date: Sep. 20, 1993

[87] PCT Pub. No.: WO92/16799

PCT Pub. Date: Oct. 1, 1992

[30] Foreign Application Priority Data

Mar. 19, 1991 [CA] Canada ..... 2038563
Nov. 8, 1991 [CA] Canada ..... 2055162

[51] Int. Cl.[6] ..... F25B 21/02

[52] U.S. Cl. ..... 62/3.3; 62/3.2; 236/46 R

[58] Field of Search ..... 62/3.2, 3.3, 3.5, 62/3.6, 259.1, 259.3, 262, 263, 324.1; 236/46 R

[56] References Cited

U.S. PATENT DOCUMENTS 3,252,504 5/1966 Newton ..... 62/3.3
5,165,465 11/1992 Kenet ..... 236/46 R

*Primary Examiner*—John M. Sollecito
*Attorney, Agent, or Firm*—Marks & Clerk

[57] ABSTRACT

A personal environment system for creating a user-definable local environment within a localized zone in an ambient space, comprises a modular housing mountable in said localized zone and having an air inlet, an air outlet incorporating a diffuser for distributing conditioned air into said localized zone, an air flow channel between said air inlet and said air outlet, and a channel for a thermal fluid for supplying or carrying away heat. a blower means causes air to flow through the air channel. A heat exchanger between the air flow channel and the thermal fluid channel and includes a thermoelectric heat pump to effect transfer of heat between air flowing through the air flow channel and the thermal fluid channel. A control unit permits the user to set the amount of heating or cooling applied by the heat pump to air flowing through said air channel to permit the user to control the air temperature within the localized zone according to personal comfort requirements independently of the general air temperature of the ambient space.

11 Claims, 14 Drawing Sheets

DESK MOUNTED PERSONAL ENVIRONMENT SYSTEM

This invention relates to environmental systems, and more particularly to an air distribution unit for use in such systems.

There is increasing concern over the comfort of personnel in the work environment, both in terms of air quality on the one hand and temperature and humidity levels on the other. With the trend toward open plan designs and sealed buildings, it becomes more difficult to ensure the comfort of individual workers. Most large buildings have centralized air conditioning units that control humidity and temperature levels and also filter out undesirable contaminants. Due to the volume of air to be processed, it takes a considerable time to condition the air in the entire building, and furthermore workers often have different individual comfort levels. Not all occupants of a building have the same comfort requirements, and however good the building design differences in temperature levels can arise between different parts of a room.

Smoking is often a problem. In many instances this is banned altogether due to its undesirable impact on non-smokers. However, such a ban can detrimentally effect the efficiency of habitual smokers.

Japanese patent publication no. J2037231 discloses a reversible Peltier effect heating and cooling device adapted to be installed in the partition wall of a room to be heated or cooled according to the preference of the occupants of the room. This device is a primary source of heat or cooling in which the discharge air is directed outside the room. The device in effect acts as a conventional heat pump arrangement and it does not cater to the personal preferences of individual room occupants. Furthermore, any heat discharged outside the room is effect wasted. No provision is made for its reuse.

An object of the invention is to alleviate the aforementioned disadvantages by allowing the individual to exercise some degree of control over his or her personal environment.

According to the present invention there is provided a environmental control system comprising a housing having an air inlet, an air outlet incorporating a diffuser, and an air flow channel between said air inlet and said air outlet; a channel for a thermal fluid for supplying or carrying away heat; blower means for causing air to flow through said air channel; a heat exchanger between said air flow channel and said thermal fluid channel and including a thermoelectric heat pump to effect transfer of heat between air flowing through said air flow channel-and said thermal fluid channel; and user-controlled means for setting the amount of heating or cooling applied by said heat pump to air flowing through said air channel, characterized in that said environmental control system is a personal environment system for creating a user-definable local environment for an individual user within a localized zone in a common space having an ambient temperature that may be different from that in said localized zone, said housing is in the form of a personal module mountable in said localized zone, said diffuser is arranged to distribute conditioned air directly into said localized zone, and said thermal fluid returns excess heat to or withdraws required heat from said common space outside said localized zone, whereby an individual user can control the air temperature within said localized zone according to personal comfort requirements independently of the general air temperature of the common space.

The housing may be in the form of a desk mountable unit that can draw air either from the room or from an air source located in a under-floor plenum, for example. This arrangement gives the user nearly complete control over the local temperature in his or her zone, which may be warmer or colder than the ambient temperature in the room. This is particular useful for large open plan offices where many workers often have different needs.

The heat pump is preferably in the form of a semiconductor Peltier-effect device thermoelectric device electrically controlled by the individual.

The thermal fluid can either be air, which is discharged away from the localized zone, or liquid from a thermal reservoir, which can be mounted below the desk of the user in the case of a workstation. The thermal reservoir can be in the form of a tank for water, preferably incorporating a substance such as glycerin to improve the heat capacity of the thermal fluid.

A filter is preferably mounted in the unit to remove particulate and other contaminants in the air flowing through the air channel.

In another embodiment, the personal environment system is in the form of a wall-mounted unit, for example located in front of a workstation in an open-plan office space. This unit contains the air intake, blower and heat pump, and can draw air from the room through and direct it through discharge nozzles into the localized zone.

The unit preferably comprises an occupant sensor and a memory for storing the preferred settings of the user. The system is de-activated when the user leaves the workstation and automatically re-activated on his or her return at the same settings.

The invention will now be described in more detail, by way of example only, with reference to the accompanying drawings, in which.

Figure 11:
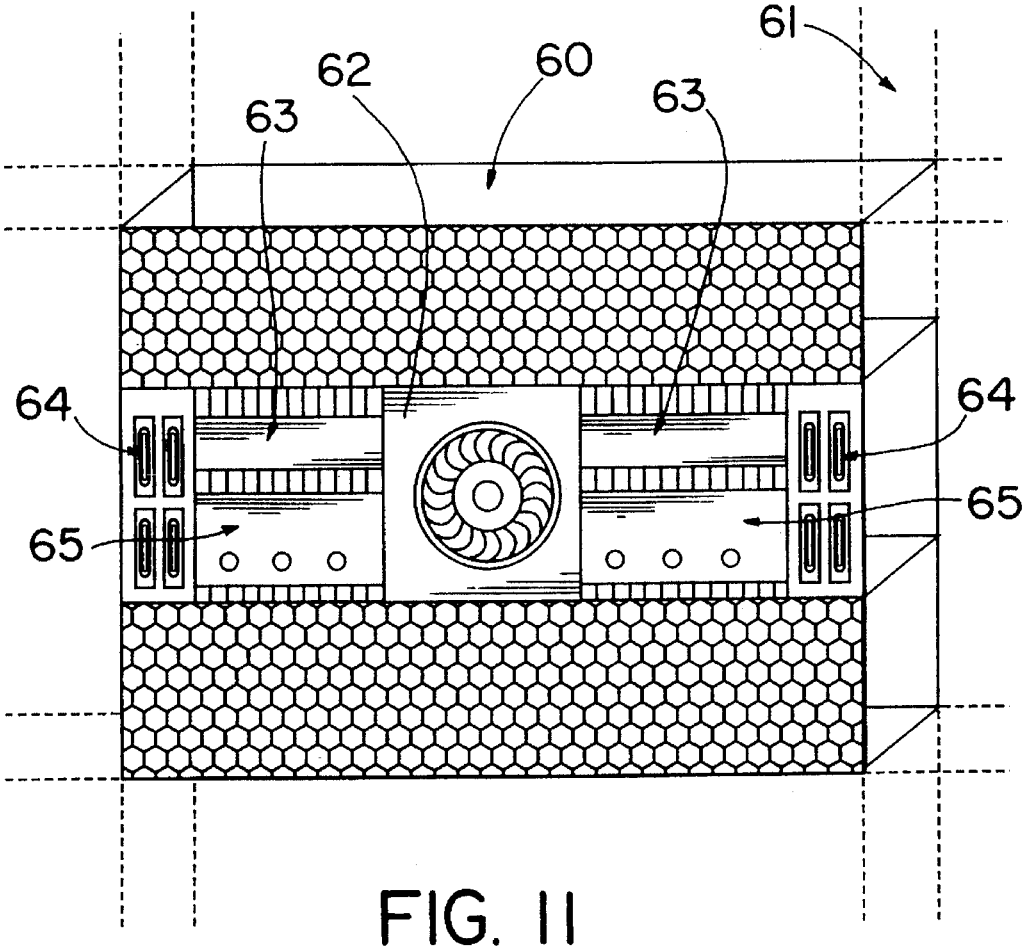
FIG. 11 is a perspective view of a wall-mounted unit.
Figure 12:
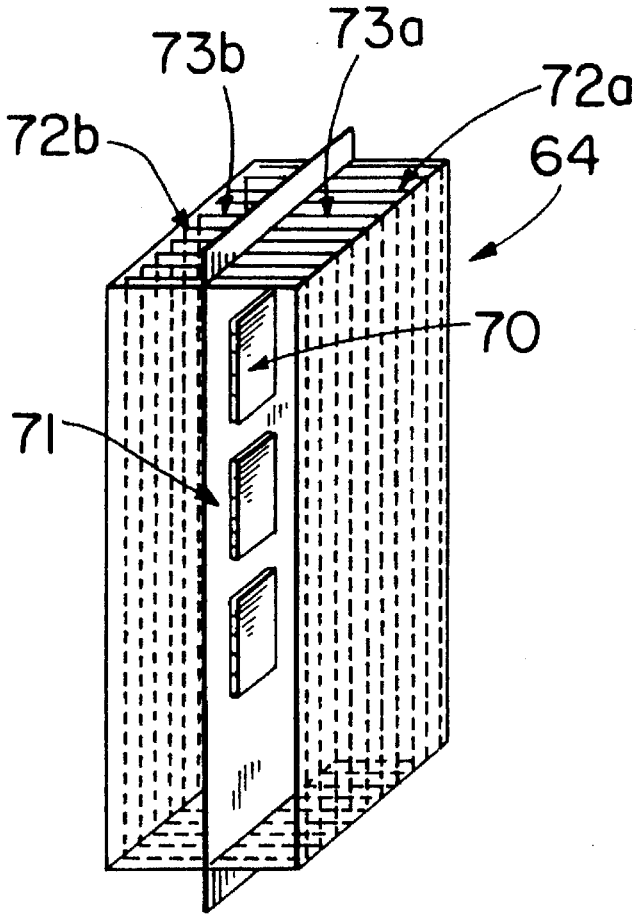
FIG. 12 shows the arrangement of heat exchanger plates in the unit shown in FIG. 11.
Figure 13:
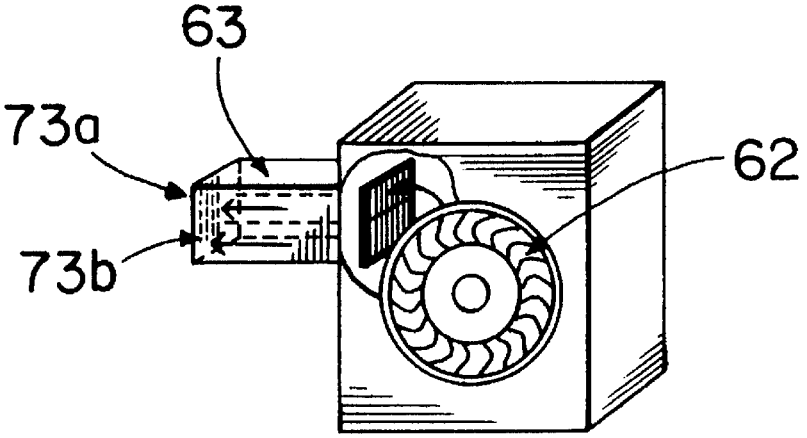
Figure 14:
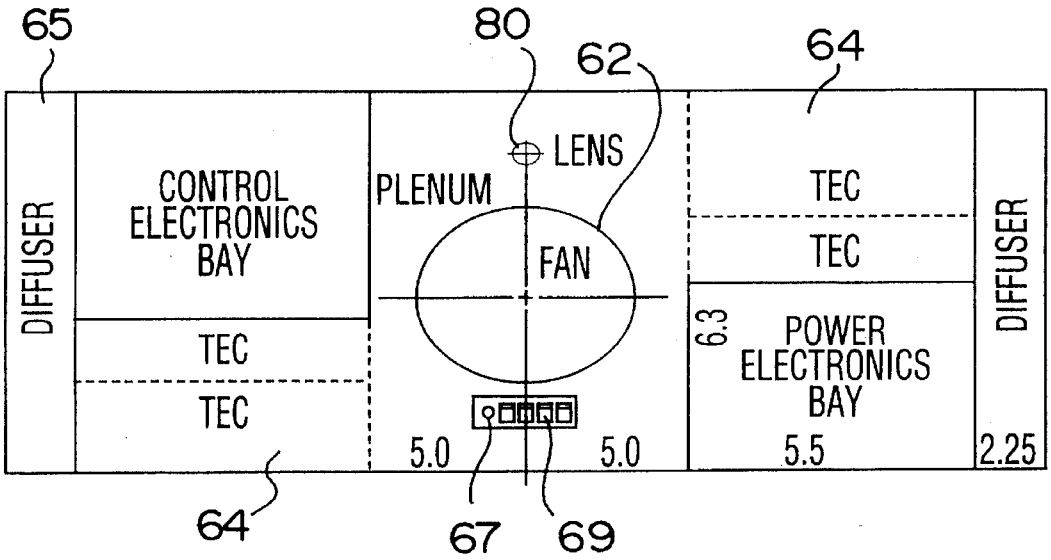
Figure 15:
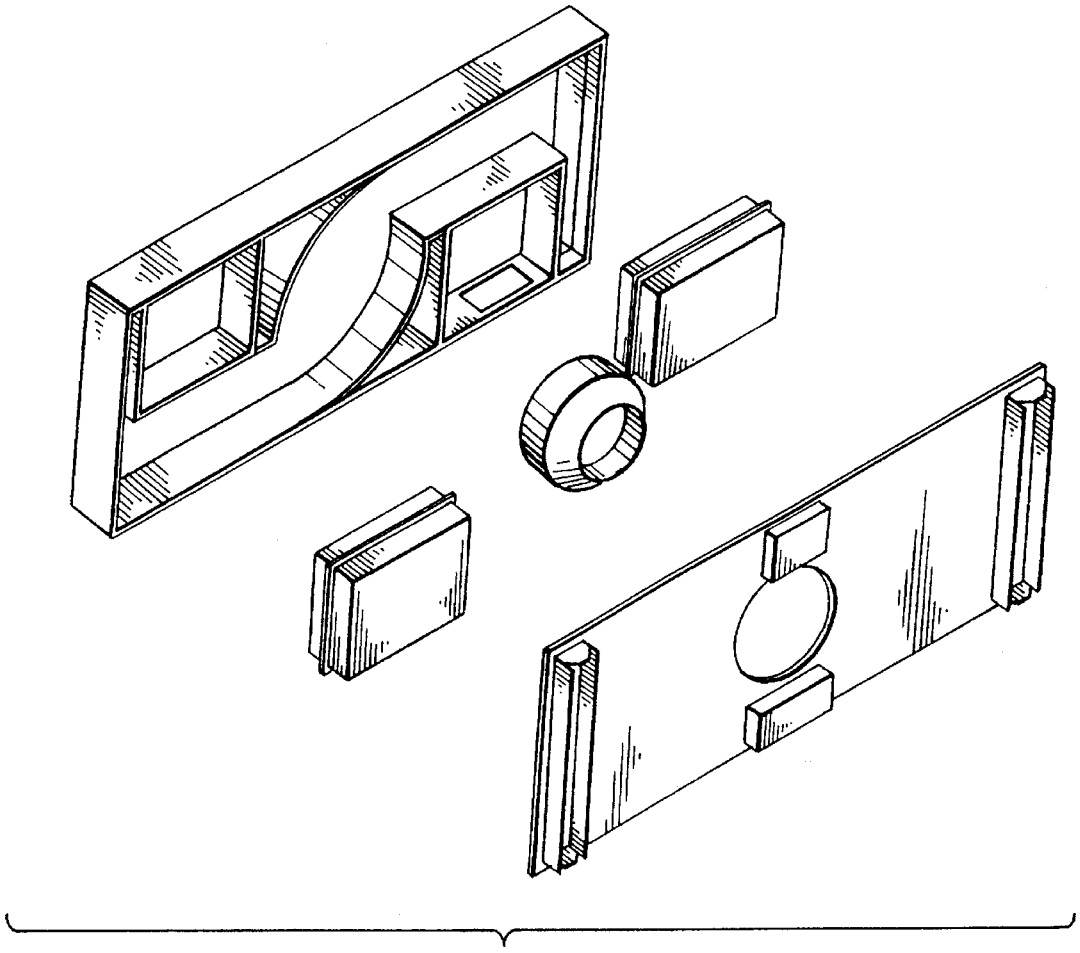
Figure 16:
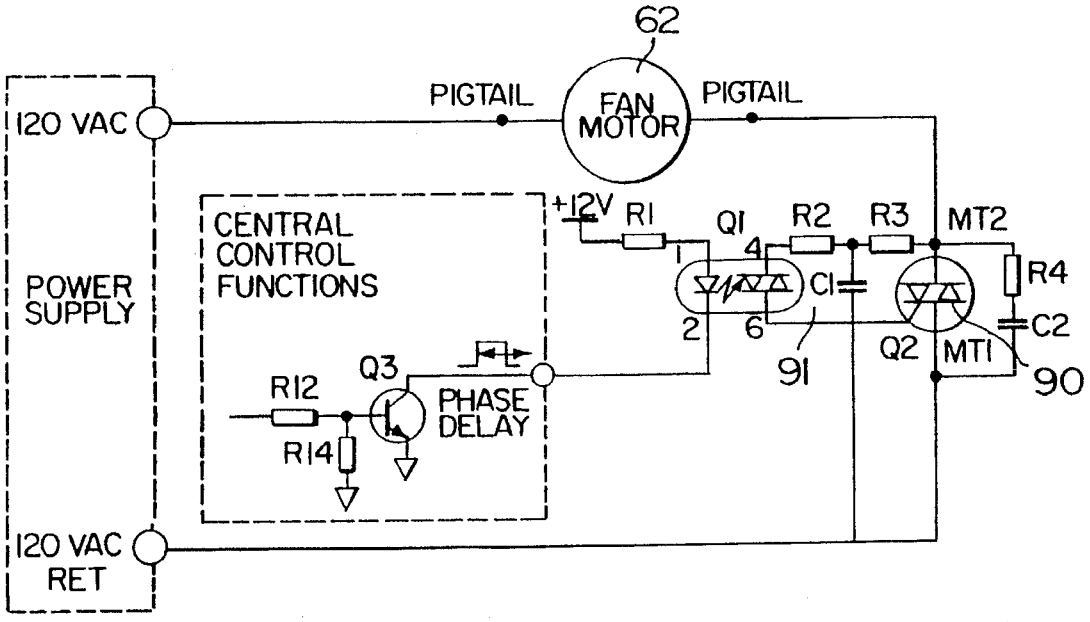
Figure 17:
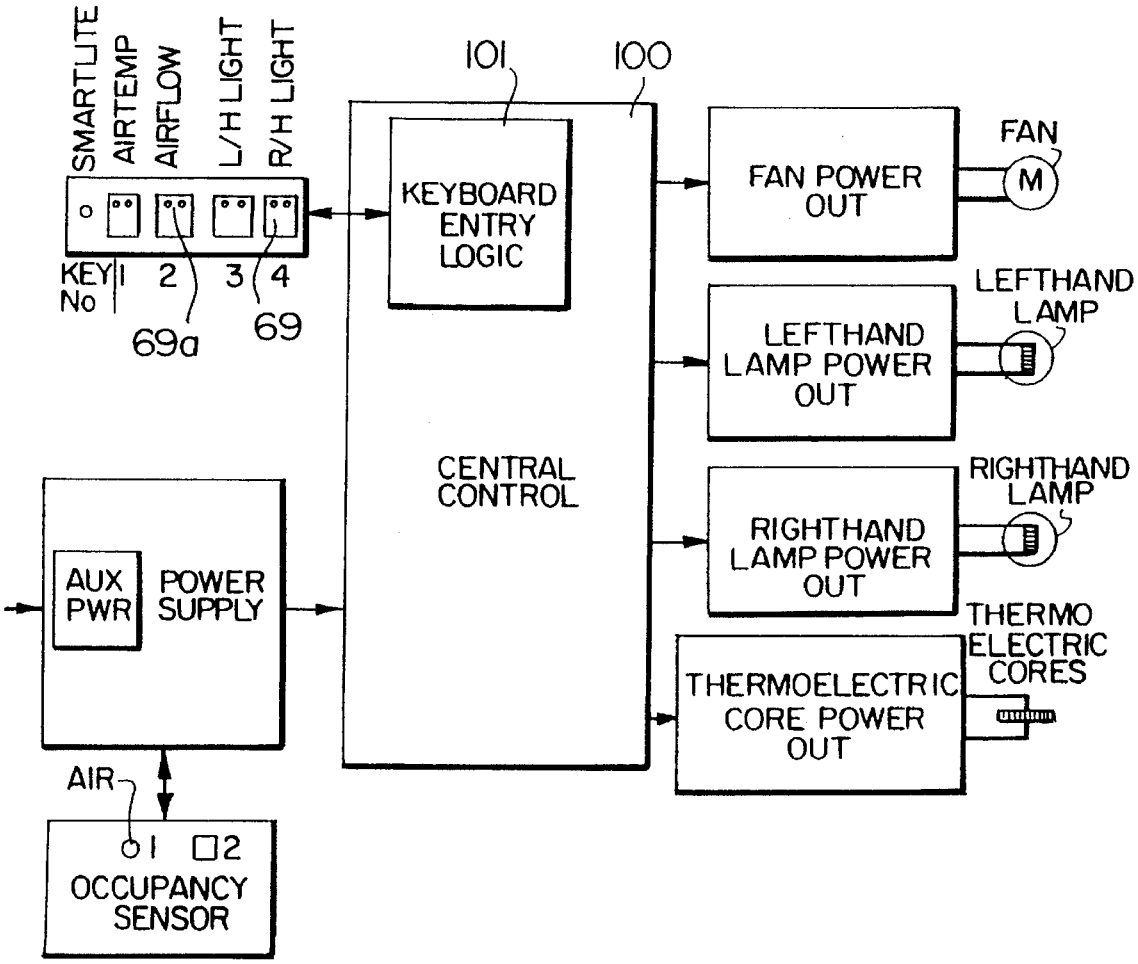

FIG. 13 shoes part of the blower and air conditioning unit for the wall-mounted unit shown in FIG. 11;

FIG. 14 is a more detailed view shoeing the front panel layout of the wall-mounted unit;

FIG. 15 is an exploded view showing parts of the interior of the wall-mounted unit;

FIG. 16 is a block diagram showing the control circuit for the blower in the wall-mounted unit;

FIG. 17 is a general block diagram of the system layout; and

Figure 18:
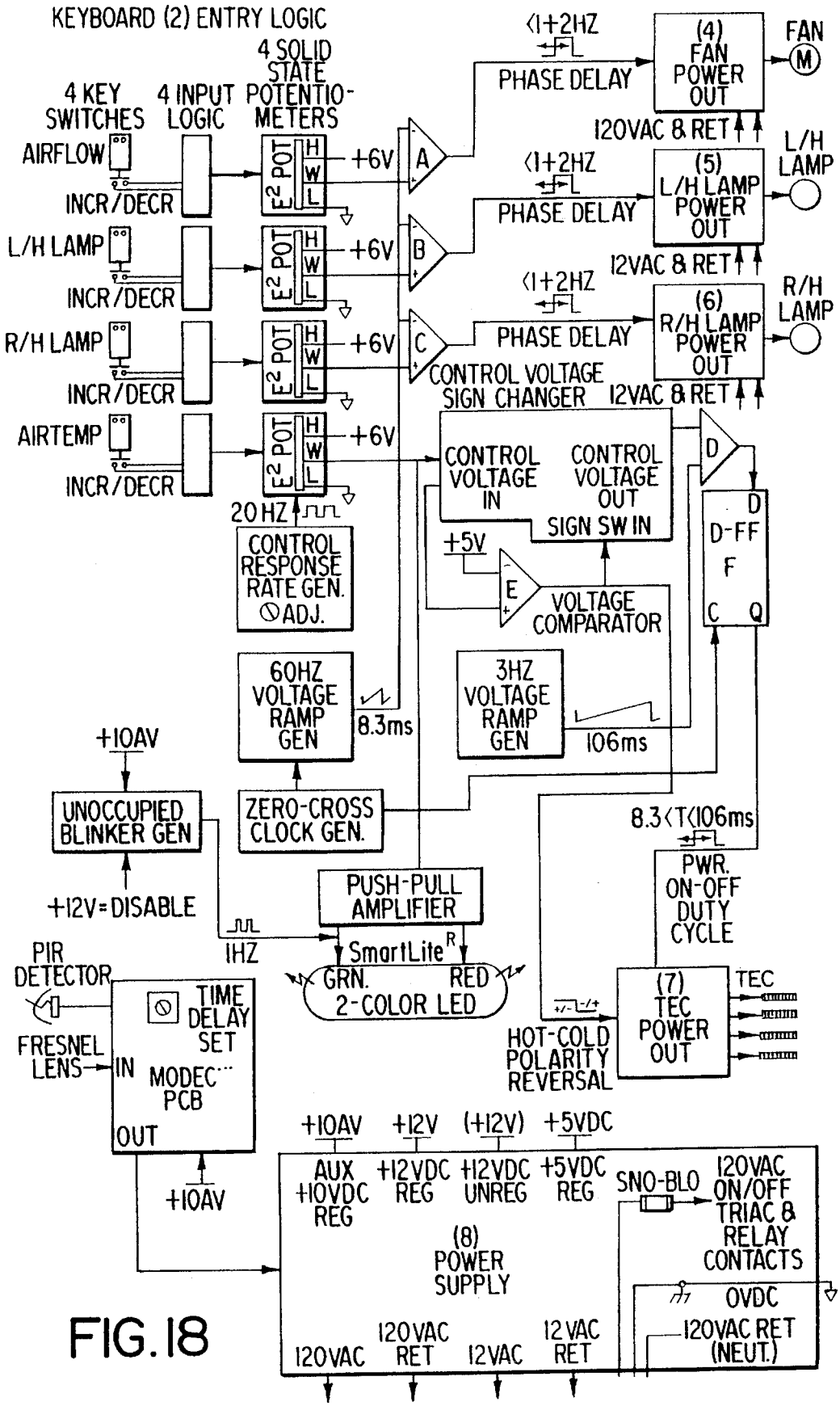

FIG. 18 is a more detailed diagram showing the main control functions of the wall-mounted unit.

Figure 1:
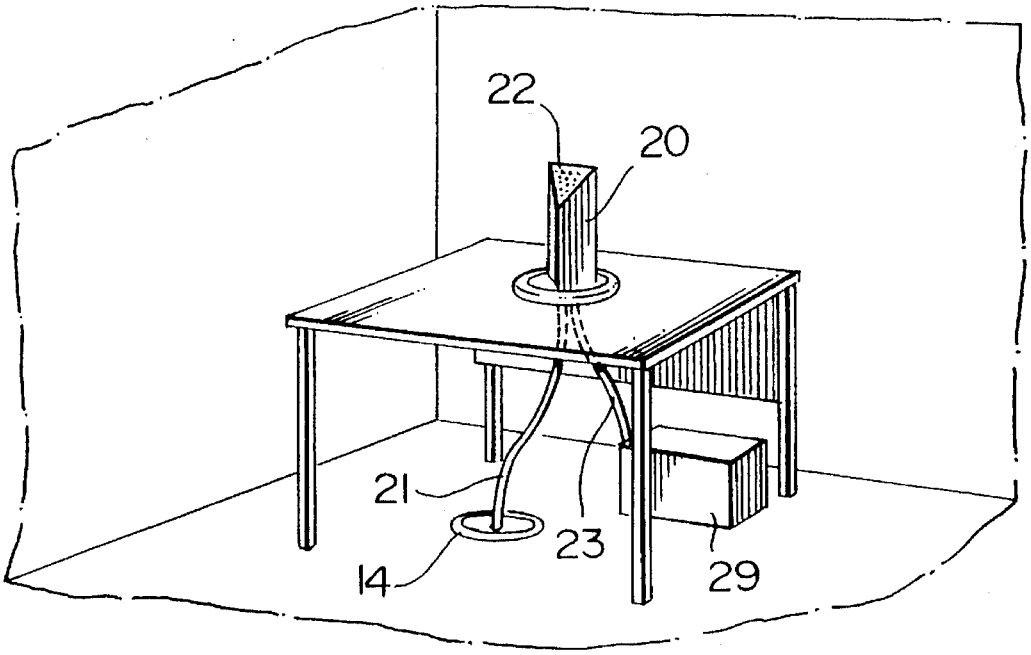
FIG. 1 is an overall perspective view of one embodiment of a desk-mountable personal environment system in accordance with the invention.
Figure 3:
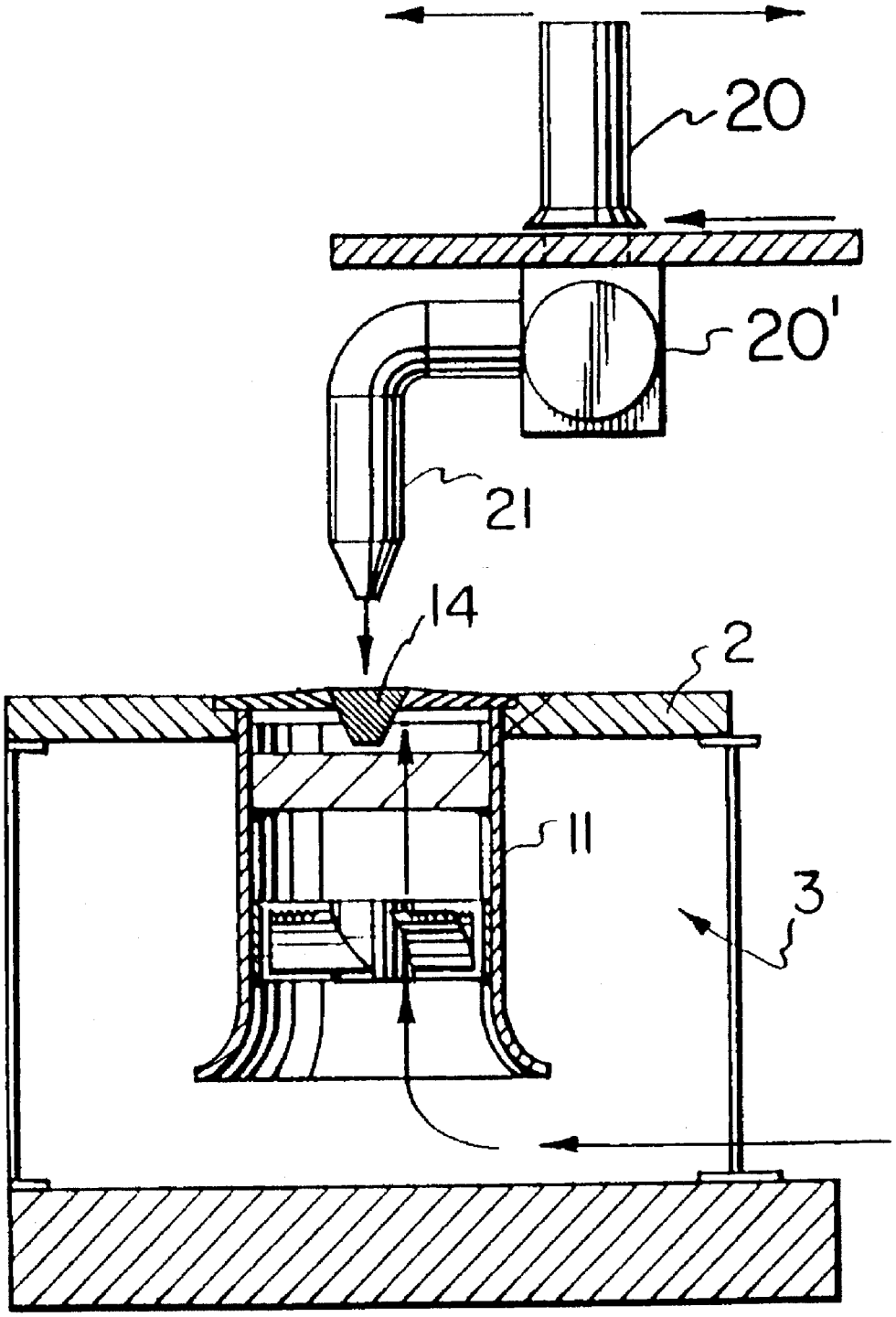
FIG. 3 is a cross section through a coupling assembly showing a floor-mounted air distribution unit as a source of air for the personal environment desk unit.

Referring now to FIG. 1, the desk mountable personal environment unit 20 is connected by a flexible hose 21 to a fresh air supply 14. The fresh air can be drawn from an under floor plenum space 3 (FIG. 3) communicating with a central air conditioning system, ductwork, or the ambient air in the room. FIG. 3 shows the air being drawn from the plenum space 3 through a fan unit 11 coupled to a flexible hose 21 through outlet 14.

The air is directed through the desk mountable unit 20 and out toward the individual through the angled, triangular grill 22, which serves as a diffuser, into a localized zone defined by an individual workstation. The desk-mountable unit 20 contains a heat pump connected by hose lines 23 to a water tank 29 mounted beneath the desk. A pump (not shown) circulates water acting as a thermal fluid through a channel in the desk-mountable unit 20 and the water tank 29.

To provide improved efficiency the heat transfer medium may consist of a mixture of about 15% by weight glycerin and water. The glycerin water mixture has a substantially higher heat capacity than water alone and therefore more efficiently transfers heat.

A high efficiency filter (not shown) is also mounted in the base of the housing for removing particulate and other contaminants from air flowing through.

Figure 2:
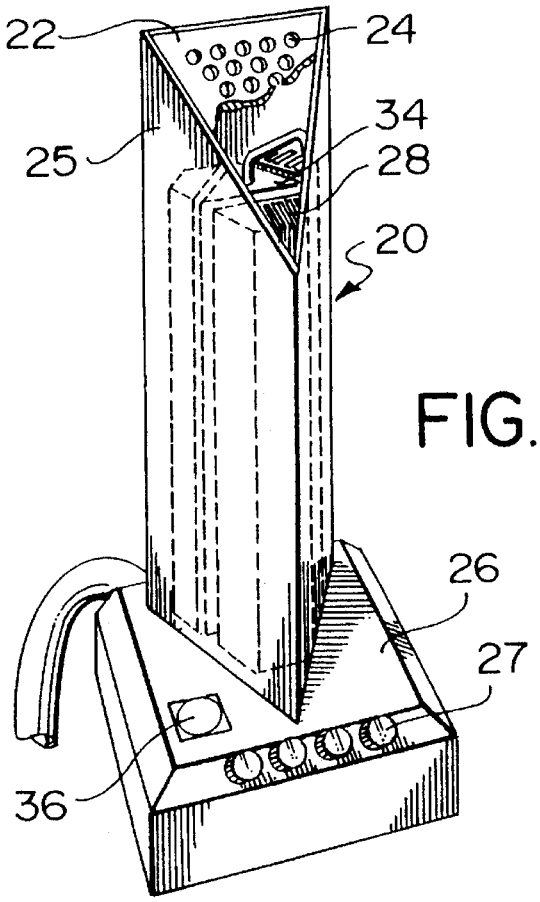
FIG. 2 is a perspective close-up view of a desk mountable unit.

The desk mountable unit 20 is shown in more detail in FIG. 2. The unit comprises an upright triangular housing 25 mounted on a rectangular base 26 provided with control knobs 27. The upper part of the housing 25 is beveled to provide the triangular, angled plate 22 with circular air distribution holes 24 through which air flows into the localized zone.

Within the housing 25 is located a heat pump-heat exchanger arrangement 28, described in more detail with reference to FIG. 4.

Figure 4:
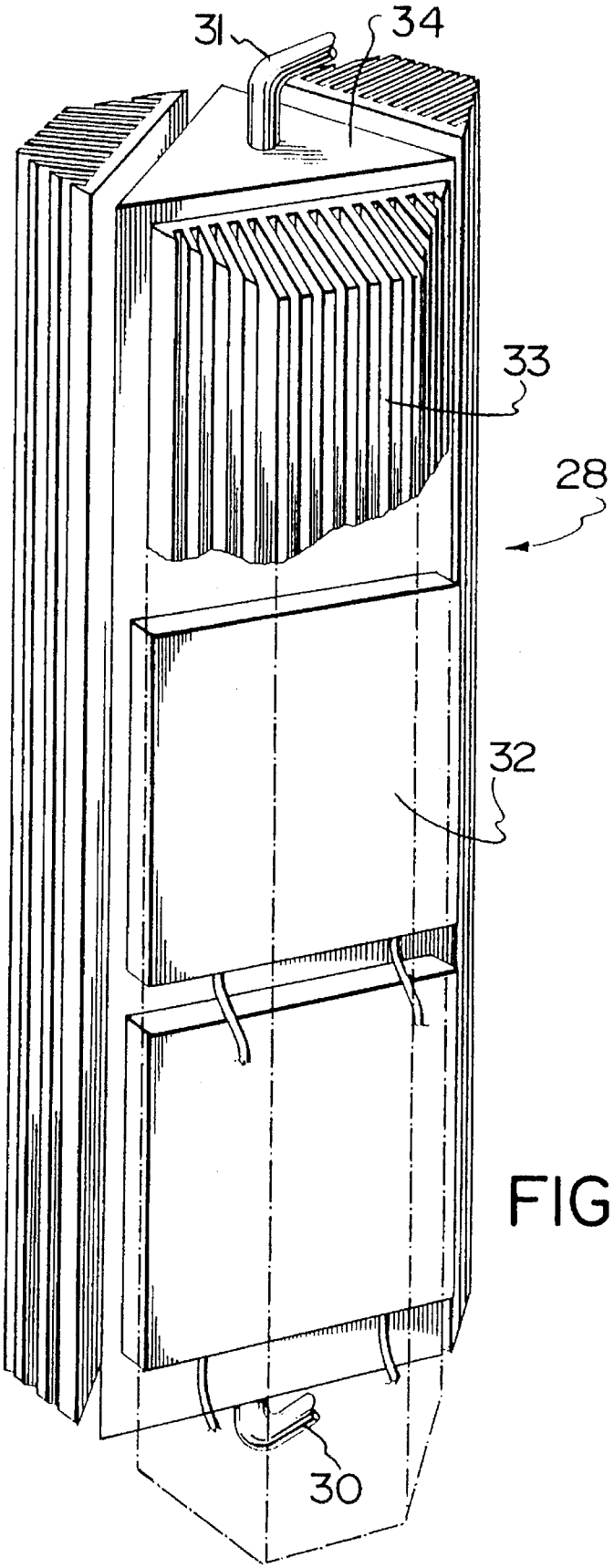
FIG. 4 is a cut away view the desk mountable showing the heat exchanger.

Referring now to FIG. 4, the heat pump arrangement 28 comprises a central closed triangular core 34 with a fluid inlet and outlet 30, 31 at the bottom and top respectively. The inlet and outlet are connected by lines to water reservoir 29. The core 34, which defines a thermal fluid channel, is angularly offset relative to the housing 25 so that the apices of the core 34 are directed towards the midlines of the faces of the triangular housing 25.

A series of thermoelectric elements 32 are glued on each of the faces of the core 34. The thermoelectric elements are commercially available semi-conductor Peltier effect devices, for example, such as the Marlow M1 1069 unit. The current through the elements 32 is adjusted by means of the controls 27 (FIG. 2) on the front of the unit.

Trapezoidal-shaped heat exchangers 33 of machined aluminum block have sets of vertical parallel fins mounted on the outer faces of the thermoelectric elements 32 to provide, with core 34, the complete heat pump assembly 28. The fins define between them portions of an air channel for air flowing through the housing.

In operation, the user controls the level and direction of current through the thermoelectric elements 32, causing heat to be withdrawn from or returned to the liquid flowing through the core 29. As a result, the incoming air flowing up through the housing 25 in the portions of the air channel between the fins of the heat exchangers 33 is heated or cooled. The unit thus gives the individual personalized control of his local temperature, which can be either lower or higher than the ambient temperature in the room. This is particularly useful in large open-plan offices, where many work stations are located in one room. Since a heat pump is employed, any energy extracted from the air is stored in the water reservoir 24 for subsequent return to the air. As a result, the unit operates at high efficiency.

Rather than take admit air from the under-floor plenum space 3, the desk-mountable unit 20 can draw air directly from the room. Since the object of the unit is not to provide self-sufficient heating or cooling as the primary air conditioning source, but rather to provide a modest temperature differential as a secondary source, in the order of ±10° C. relative to the ambient air, the thermal fluid can also be air that is drawn in from the room and discharged away from the user.

Figure 5:
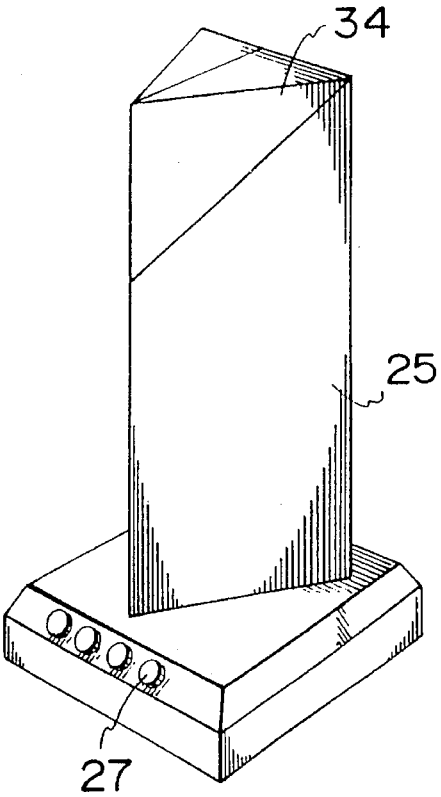
FIGS. 5 and 6 are views of a second embodiment of a desk mountable unit incorporating a retractable lamp.
Figure 6:
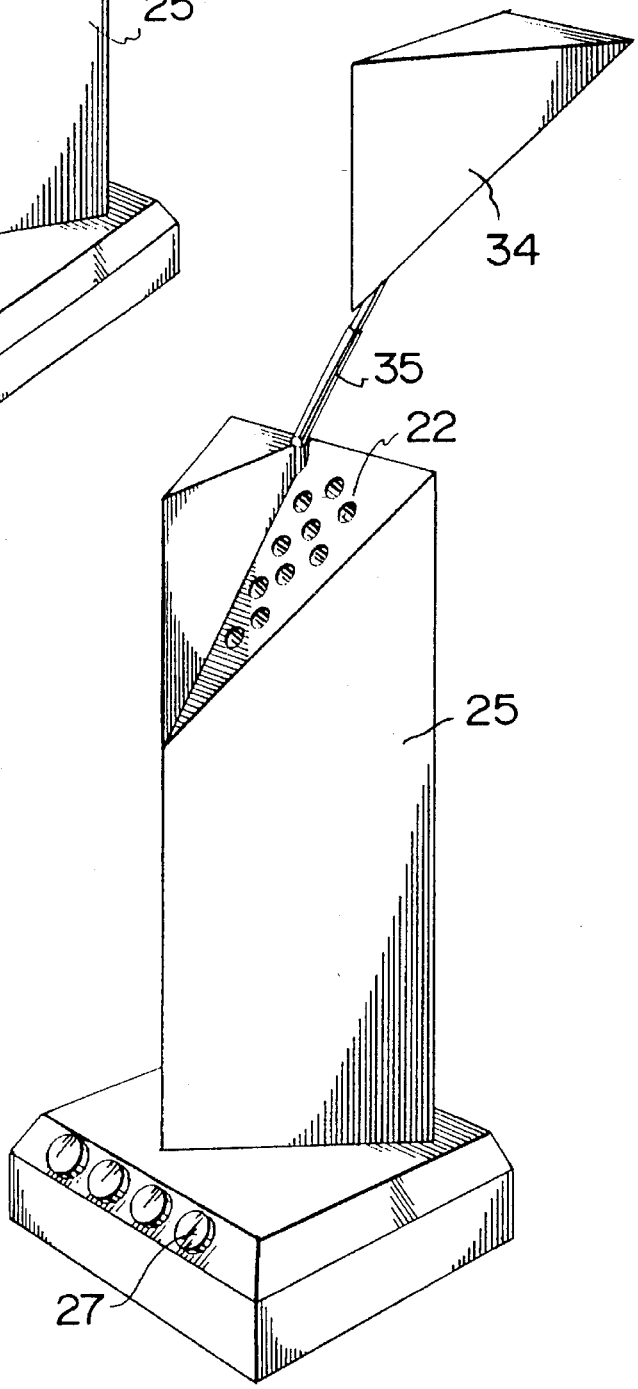

FIGS. 4*a* and 4*b* show a modified version of the desk mountable unit incorporating a retractable lamp. In this version, one half of the top of-the unit 25 is beveled to provide grill 22. A triangular lamp 34 is mounted on an articulated arm 35. The lamp 34 has a shape complementary to the remaining portion 35 of the top of the housing 25 such that in the closed position (FIG. 5) it may be mated with the top of the housing to close the grill 22.

Figure 9:
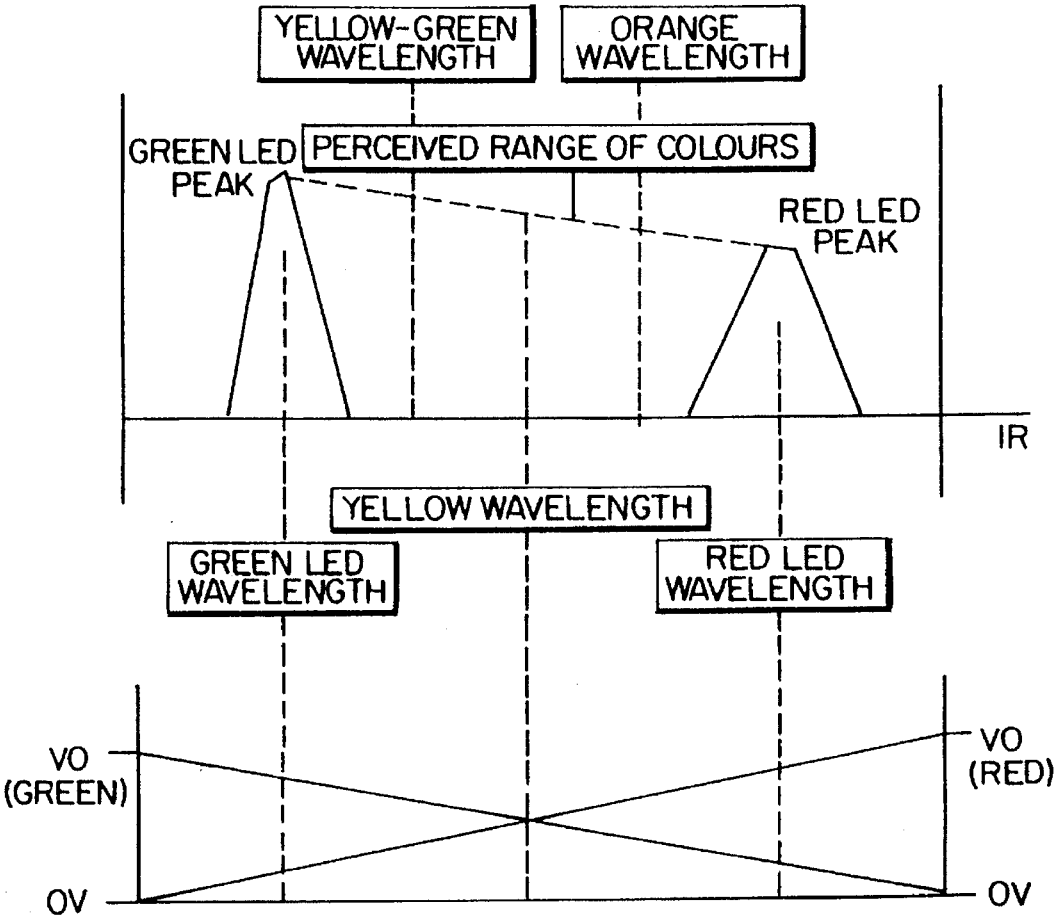
FIG. 9 shows the variation in perceived colour as red and green LED's are selectively energized.
Figure 10:
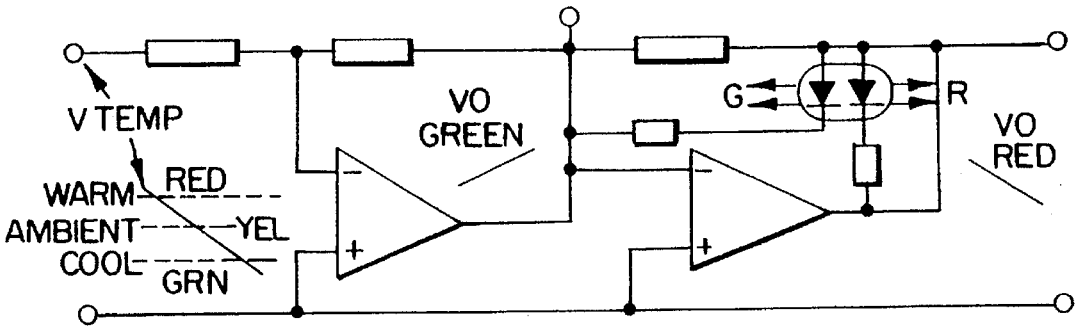
FIG. 10 is a diagram of a circuit for energizing the LED's.

The base 26 of the unit is provided with different coloured LED's 35, for example, red, amber, and green or blue to indicate the status of the unit. Red normally indicates the heating mode, blue or green the cooling mode, and amber the neutral mode in which heat is neither supplied to nor withdrawn from the air stream flowing through the unit. Alternatively, by placing red and green LED's side by side so that they form a common source of light, and energizing them selectively with the circuit shown in FIG. 10, a gradation of colours from green to red can be generated as shown in FIG. 9. In this arrangement, green represents maximum cooling, red maximum heating, and the various shades of amber in between correspond to the intermediate heating, cooling states, or neutral states of the unit. The same effect can be achieved with a single LED capable of changing colour depending on how it is energized.

The desk-mountable unit 25 permits the individual to exercise additional personal control by supplying air into the localized zone at a temperature which may be higher or lower than ambient temperature or the temperature of the air coming from the central air-conditioning system through the plenum space. It can direct the air flow toward the individual at a controllable rate of zero to 80 cfm according to personal preference. For this purpose a separate fan 36 can be incorporated in the base of the unit or can be mounted externally.

The thermoelectric heat pump provides a coefficient of performance (COP) of 2.5 to 3.5 and provides up to 5° C. cooling or 7.5° C. heating. This is not sufficient to act as a primary source, but it is sufficient to permit an occupant to vary his or her local environment in accordance with personal comfort requirements. In a hot, stuffy room, a 5° C. temperature differential is quite noticeable.

Returning to the FIG. 3 embodiment, part of the housing 20' is arranged as a separate unit containing thermoelectric cell and fan unit 36, which is mounted directly under the desk. In this embodiment the main housing 20 mounted above the desk acts as a passive air distribution unit.

Figure 7:
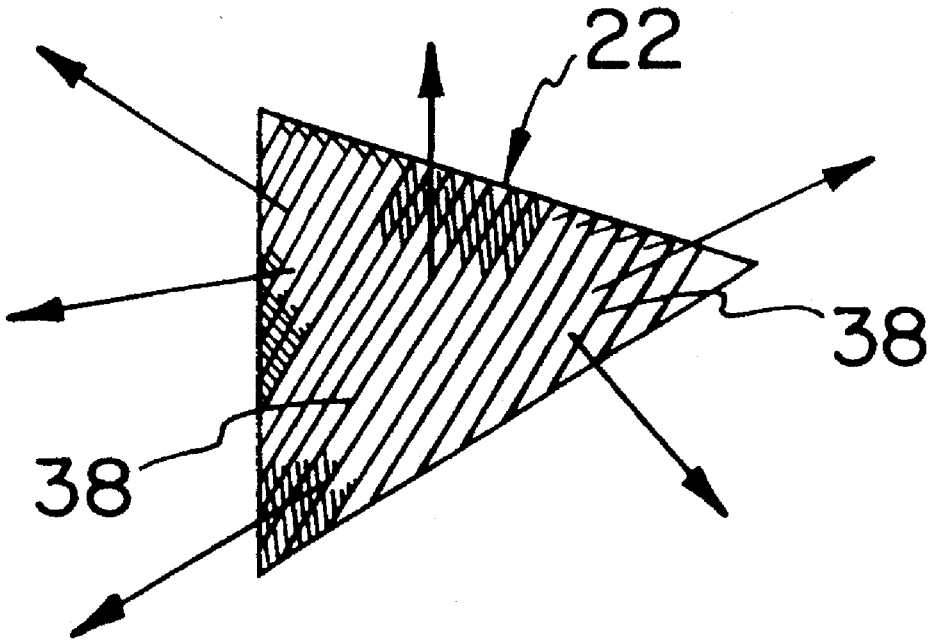
FIG. 7 shows a different form of grill plate for the desk mountable unit.
Figure 8:
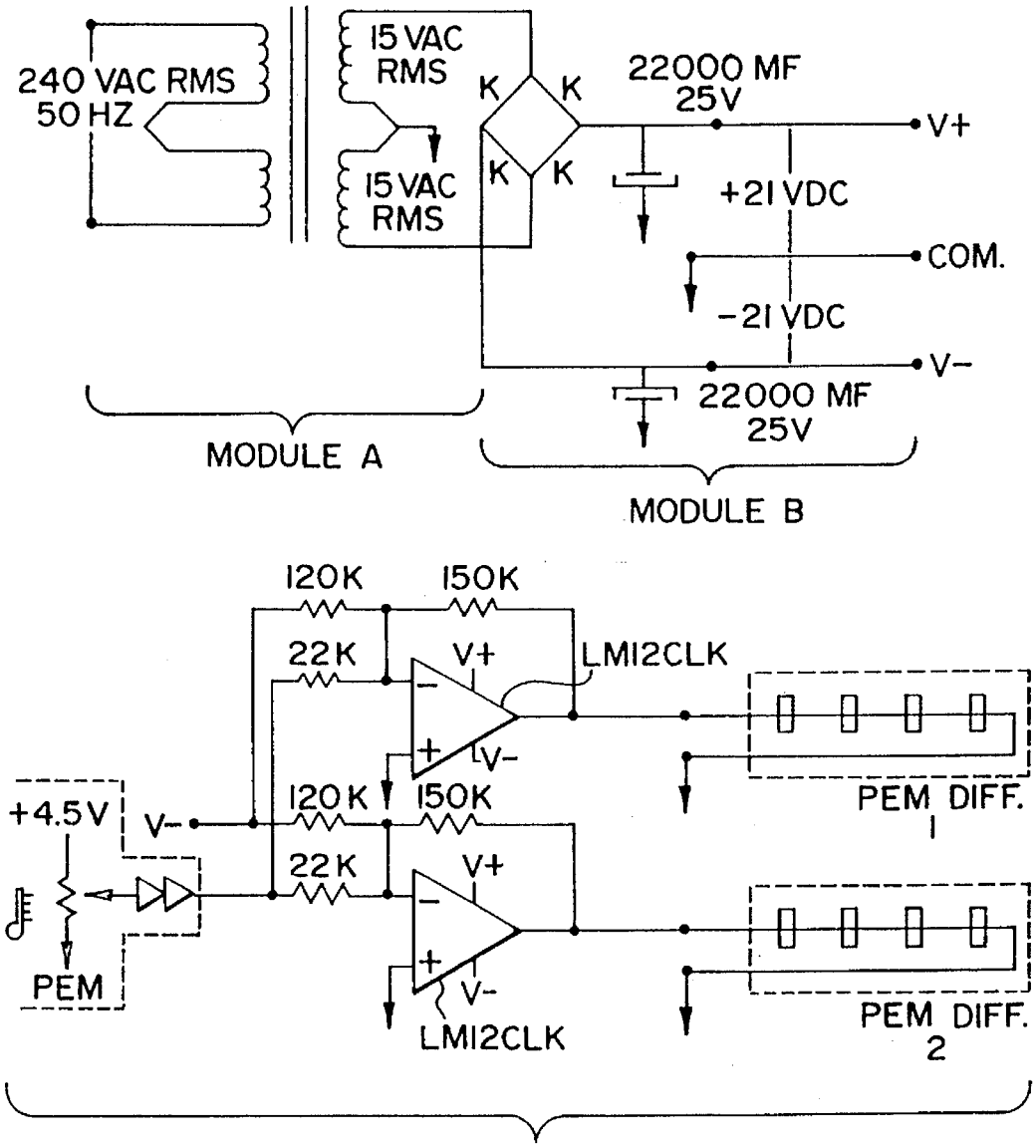
FIG. 8 is a circuit diagram of the fan control circuit.

As shown in FIG. 7, the top plate 22 can be provided with machined channels 38 forming an outlet grille instead of the circular holes shown in FIG. 1. The walls channels 38 can be set at a different angles to eject the outflowing air in different directions as shown by the arrows. This arrangement provides adequate comfort without directing the air directly toward the individual, which might create the impression of a draft.

The efficiency of a heat pump depends on the temperature differential between that source and sink. Since the personal environmental units are only required to operate over a relatively small range on the ambient air, their efficiency can be very high. For instance, if the ambient is at 21° C., it is unlikely that any particular individual will want to work in an environment different from the ambient by more than a few degrees.

The desk mountable units can be used to maximize comfort levels in an open-plan environment, such as may be found in a large building while at the same time maximizing efficiency. A common complaint of individuals is the stuffiness present in modern tightly sealed, energy efficient buildings. By providing a localized source of freshly filtered and conditioned air, the personal environment unit reduces this problem. Each individual has personal control over his or her immediate environment.

The unit is environmentally friendly since it uses a thermoelectric heat pump, it does not employ CFC's. It operates independently of the central air supply system at a power load of less than 170 watts.

If desired, the device can be activated by an infra-red occupancy sensor designed to activate the desk-mountable unit according to preset conditions when an individual is present at the desk. The user can set up an environment according to his or her needs. This information is stored in memory. When the user leaves the desk, the unit is de-activated, and when he or she returns, the personal environment unit is automatically re-activated at the preset levels.

FIG. 11 shows a personal environment unit in the form of a wall-mounted unit 60, for example adapted to be fitted into a wall forming part of a workstation partition.

The wall unit 60 comprises a central blower 62, which draws in air from the room immediately in front of the occupier of a localized zone defined by the workstation and passes it through heat exchanger units 63 to directable outlet vents 64. The blower 62 has an a.c. powered, phase-controlled motor to provide a wide range of speed variation at minimum noise levels. It operates at zero to 150 cfm (cubic feet per minute).

The airflow can be controlled manually through control units 65, which control the speed of the fan or electronically in response to sensor inputs. For example, the unit can be provided with an infrared sensor to sense the presence of an individual at the workstation, in which case the unit can be activated at a preset level.

Air drawn in by the blower is passed through heat exchanger units comprising an aluminum block in the form of a median conductive plate 71 with thermoelectric semiconductor heat pump elements 71 glued to the face thereof. A stack of heat-exchanger fins 72*a*, 72*b* is arranged on each side of, and perpendicular to, the control plate 70. Air flow paths 73*a*, 73*b* forming portions of the air flow channel through the unit are defined between the fins of each stack 72*a*, 72*b*. On one side of the heat exchanger, 73*a*, the air flows to the nozzles 64, which direct the air into the direct vicinity of the person at the workstation. On the other side, 73*b*, the air flows to a discharge outlet (not shown) away from the workstation. Since the unit is only intended to provided a localized temperature differential above or below the ambient temperature it does not matter that excess heat or cold is discharged into the room away from the user. Some users may prefer temperatures higher than the ambient, whereas some users may prefer lower temperatures. These two classes of user will cancel out. If there are more users on one side of the median temperature than the other, the room temperature will rise or fall as the case may be, in which case the primary system will be activated to restore the ambient conditions.

The thermoelectric semiconductor heat pump elements 71 are controlled by the control units 65 on the front of the wall unit 60. By varying the magnitude and direction of the current in the thermoelectric elements 71, heat can be either from or added to the heat flowing out of outlets 64, and with a complementary heating or cooling of the air flowing through the path 73*b* to the discharge outlet.

FIG. 14 shows the general layout of an improved embodiment of the wall-mounted unit. The blower 62 is centrally located as in FIG. 11, with thermoelectric heat pumps 64 diametrically disposed on either side of the blower 62. Control and power units 65 are located adjacent the heat pumps 64. Directable diffuser nozzles are located on either side of the unit.

A control panel 79 is located below the blower 62 on the front of the unit. The control panel includes a Smartlite® LED 67, which glows red if the air is being heated, blue if it is being cooled, and amber if no heat transfer is taking place. The remaining buttons allow the user to set the level of heating or cooling according to personal needs and other environmental factors in the workstation. For example, the control panel 69 can also set the lighting level and the degree of background noise provided by a white noise generator, not shown.

The control units 65 include a memory for storing the user's preferences. Infrared occupancy sensor senses the presence of an occupant. When the occupant leaves the workstation, the unit is de-activated, and when he or she returns the unit is re-activated at the previously set levels.

FIG. 15 is an exploded view that helps show the internal configuration of the unit 60.

FIG. 16 shows the control circuit for the blower 62. This is phase-controlled by triacs 90, 91 and can run at extremely low noise levels.

FIG. 17 shows an overall block diagram of the system. The control panel 69 has buttons 69*a* that allow the level of the various environmental systems to be preset. The buttons operate digital systems that ramp up or down according to the dwell time of the user's finger on the buttons.

The system is controlled by central control unit 100, which incorporates a microprocessor and keyboard entry logic unit 101. FIG. 18 is a more detailed circuit diagram of the system.

The wall unit thus provides localized heating or cooling for individual and in particular workstations and is well suited to large open plan offices, where different workers may have different needs.

Each worker can operate in a personal environment that is at a slightly different temperature from, either above or below, the ambient temperature. If the ambient temperature is set at the median comfort level of the occupants of a room, the some workstations will take heat from the ambient and some will return heat depending on the preference of the individual. On balance the room temperature will remain constant. If there is a greater amount of cooling or heating as a result of more workstations being in the cool or heat mode respectively, the conventional room thermostats will ensure that more or less general heating or cooling is applied to the room ambient as appropriate.

We claim:

1. A personal environment system for creating a user-definable local environment within a localized zone in an ambient space, comprising:

a modular housing comprising an upright desk mountable, triangular prismatic body with an inclined truncated top, said housing being mountable in said localized zone and having an air inlet, an air outlet incorporating a diffuser for distributing conditioned air into said localized zone, said air outlet being defined by said truncated top, an air flow channel between said air inlet and said air outlet, and a channel for a thermal fluid for supplying heat from or carrying away heat to a common space outside said localized zone;

blower means for causing air to flow through said air channel;

a heat exchanger between said air flow channel and said thermal fluid channel and including a thermoelectric heat pump to effect transfer of heat between air flowing through said air flow channel and said thermal fluid channel;

and user-controlled means for setting the amount of heating or cooling applied by said heat pump to air flowing through said air channel to permit the user to control the air temperature within the localized zone according to personal comfort requirements independently of the general air temp mature of the ambient space.

2. A personal environment system as claimed in claim 1, characterized in that said heat exchanger comprises an elongate hollow block of polygonal cross section fitted within the housing and having a set of outwardly protruding, longitudinal parallel fins on lateral faces thereof, adjacent pairs of said fins defining between them portions of said air flow channel, and said thermoelectric heat pump comprising flat thermoelectric cells mounted on said lateral face between said face and said fins, and said thermal fluid channel extends within said block.

3. A personal environment system as claimed in claim 2, characterized in that said housing and said block are in the form of triangular prisms, with said block fitted inside said housing and rotationally offset such that the flat walls of the block face the apices of the housing.

4. A personal environment system as claimed in claim 1, comprising means for sensing the presence of an occupant in said localized zone, and means for activating said blower means in response to a signal from said sensing means indicative of the presence of an occupant in said localized zone and deactivating said blower means in the absence of a said signal.

5. A personal environment system as claimed in claim 4, characterized in that said sensing means comprises an infrared sensor.

6. A personal environment system as claimed in claim 4, further comprising memory means for storing an occupant's preferred control setting, whereby on the return of an occupant to the localized zone the system is automatically activated at the occupant's preferred setting.

7. A personal environment system as claimed in claim 1, further comprising a light source of changeable colour and means for changing the colour of said light source in accordance with the state of the thermoelectric heat pump.

8. A personal environment system as claimed in claim 7, characterized in that the colour of said light source gradually changes from blue when said heat pump is in a cooling state to red when said heat pump is in a heating state.

9. A personal environment system as claimed in claim 1, characterized in that said truncated top comprises an inclined triangular plate for egress of air therefrom with a plurality holes formed therein.

10. A personal environment system as claimed in claim 1, incorporating a filter in the air flow path to remove particulate and other contaminants therefrom.

11. A personal environment system as claimed in claim 1, further comprising filter means in said housing for removing particulate and other contaminants from air flowing through said air channel.

* * * * *